US006508720B1

(12) United States Patent
Wheat

(10) Patent No.: US 6,508,720 B1
(45) Date of Patent: Jan. 21, 2003

(54) PUTTING PRACTICE DEVICE

(76) Inventor: Cleveland E. Wheat, 1419 Greenmont Ct., Reston, VA (US) 20190

( * ) Notice: Subject to any disclaimer, the term of this patent is extended or adjusted under 35 U.S.C. 154(b) by 0 days.

(21) Appl. No.: 09/895,068

(22) Filed: Jul. 2, 2001

(51) Int. Cl.[7] ..... A63B 69/36
(52) U.S. Cl. ..... 473/183; 473/191
(58) Field of Search ..... 473/183, 191, 473/194

(56) References Cited

U.S. PATENT DOCUMENTS 2,709,594 A 5/1955 Brandell
2,719,719 A * 10/1955 Sherwan ..... 473/183
3,467,389 A * 9/1969 Scholin et al. ..... 16/49
3,810,632 A * 5/1974 Brandell ..... 473/183
4,249,739 A * 2/1981 Brandell ..... 273/122 A
4,563,009 A * 1/1986 Nagasaki et al. ..... 473/183
5,174,574 A * 12/1992 Knox et al. ..... 273/127 C
6,213,887 B1 * 4/2001 Carney ..... 473/183

* cited by examiner

*Primary Examiner*—Mark S. Graham

(57) ABSTRACT

A golf putting practice device (10) having a ball tray (16) that can be pivoted from the normally flat position for ball retrieval to fold substantially upright against the body of the main housing (12) for compact storage or transport. A spring-powered flipper device (28) is pivotally mounted between the base (14) and main housing (12) top and horizontally disposed along the rear face of the ball tray (16) to return the ball to the person making the putt.

11 Claims, 4 Drawing Sheets

PUTTING PRACTICE DEVICE

BACKGROUND

Field of Invention

This invention relates to golf putting practice devices and, more particularly, to golf putting practice devices of the type embodying a feature to return a ball back to the person executing a putt.

Various putting practice devices, which use mechanisms to return the ball to a person, have been heretofore known in the art. Some of these devices use spring loaded or solenoid operated catapult type ball return systems. One version employs a sliding carriage assembly mounted on a track and equipped with a paddle. An electric motor using a pulley and belt assembly drives the carriage assembly with the attached paddle that sweeps the ball forwardly to the end of the track where a pivoting action of the paddle flips the ball back to the person executing the putt. Another device uses a ball returning target plate located at the front of the device to return the ball. When the ball makes contact with the target plate, a solenoid located behind the target plate is activated and strikes the target plate, causing it to rapidly move forward and propel the ball back to the putter. This device uses the target plate as an intermediary between the ball and the striking action of the solenoid.

Previous versions of putting practice devices require large housings to provide extra weight for stability and to accommodate the interior space requirements for the various catapulting systems to retract and then move forward to eject the ball. These devices also employ huge ball trays that create oversized targets in an effort to gather any putts that may have otherwise missed. The majority of these devices require commercial electrical power to operate. These bulky putting practice systems do not afford a truly compact and convenient carry-along putting practice device.

OBJECTS AND ADVANTAGES

It is the primary object of the present invention to afford a novel putting practice device that is substantially smaller in size than existing prior art.

Another object of the present invention is to afford a ball returning means that requires substantially less space and weight for operation, thereby, rendering a device that is extremely compact and portable.

Other objects and advantages of the present invention are to afford a putting practice device with a ball tray as part of the main apparatus that can be pivoted with relation to the main housing to provide a smaller footprint for the device for storage or carry-along purposes.

Another object of the present invention is to afford a more realistic putting practice target that more simulates the size and shape of the actual hole on the golf course.

A further object of the present invention is to afford a putting practice device with a ball tray as part of the main apparatus that has a floor with a substantially shallow slope rearward, thereby affording a more flattened ball tray front entrance.

Another object of the present invention is to eliminate the extra force needed in the stroke when putting the ball to overcome the steep incline of the ball tray ramp of conventional putting practice devices and afford a more natural putting action for stroking the ball.

Another object of the present invention is to provide a golf putting practice device that is battery powered for convenience and portability as a carry-along putting practice device.

Other objects and advantages of the present invention are a means to deactivate the practice putting device by means of a switch to turn the power off when not in use to prevent unintentional activation during transporting or storage.

Another object of the present invention is to provide a golf putting practice device with an indicator that warns when the power to the unit is turned on and the putting practice device is ready for operation.

Other and further objects of the present invention will be apparent from the following description and claims and are illustrated in the accompanying drawings, which, by way of illustration, show the preferred embodiment of the present invention and the principles thereof and what are considered to be the best mode in which to apply these principles. Other embodiments of the invention embodying the same or equivalent principles may be used and structural changes may be made as desired by those skilled in the art without departing from the present invention and the purview of the appended claims.

SUMMARY OF THE INVENTION

The present invention affords a golf putting apparatus having an attached ball tray for receiving a golf ball putted thereinto. The ball tray pivots with relation to the front of the housing to a substantially upright position for compact storage of the apparatus. A flipper device is pivotally mounted about a vertical axis and disposed longitudinally along the rear face of the ball tray. The pivoting end of the flipper device is connected to one end of a tension spring that is secured at the other end to a secondary fixed anchor. A mechanical means engages and pivots the flipper device from the extended position, perpendicular to the ball tray against the resistance of the spring, to the retracted position along the back of the tray. This action causes an elongation of the tension spring, which exerts a resilient force at the pivoting end of the flipper device. When the flipper device is released from the retracted position, the resilient contracting force of the spring moves the flipper rapidly forward in an arc of approximately 45 degrees. The forward pivoting movement of the flipper device engages the ball and sends the ball back to the person making the putt.

REFERENCE NUMERALS IN DRAWINGS

Figure 1:
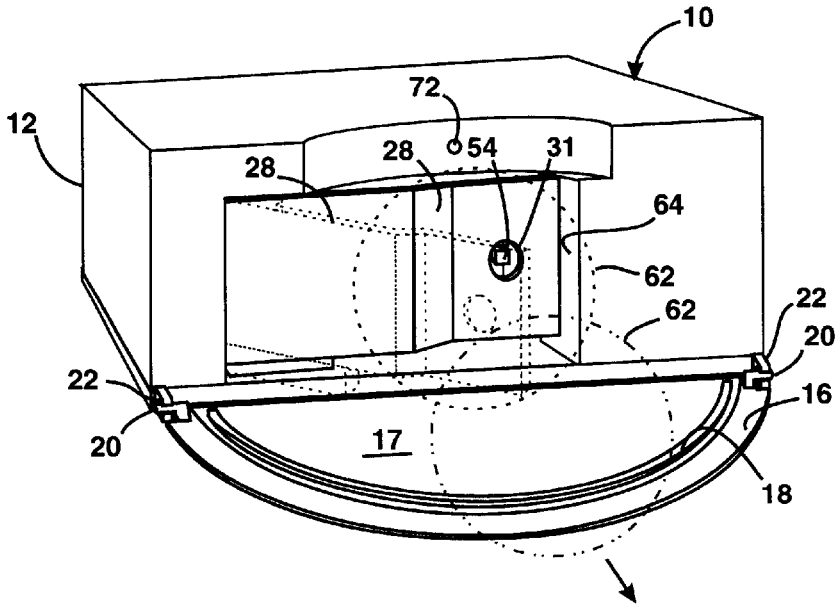
FIG. 1 is the front perspective view of a golf putting practice device embodying the principles of the present invention.

10 putting practice device
12 main housing
14 base
16 ball tray
17 ball tray floor
18 ball retard rib
20 pivot arm
22 pivot socket
24 pivot rod
26 pivot hole
28 flipper device
30 switch arm
31 switch opening
32 trigger
34 trigger stop
36 axle
38 tension spring
40 fixed anchor
42 pivotal anchor
44 anchor support
46 cogwheel
48 cogwheel arm
50 resilient movable contactor
52 retractor switch
54 release switch
56 resilient movable contactor
58 side support member
60 top support member
62 ball
64 ball pocket
66 outline of shell
68 motorized mechanism
70 outline of ball tray
72 light emitting diode (led)
74 main switch

DETAILED DESCRIPTION OF THE INVENTION

A game device in the form of a golf putting practice device 10, embodying the principles of the present invention, is shown in FIGS. 1–7, inclusive, of the drawings, to illustrate the presently preferred embodiment of the present invention.

The golf putting practice device 10 embodies, in general, a main housing 12 to enclose the ball return apparatus, a ball tray 16 for receiving the ball, a base 14, a ball return flipper device 28 disposed longitudinally along the rear face the ball tray 16 for returning a ball from the ball tray 16 to the person putting the ball thereinto.

Figure 3:
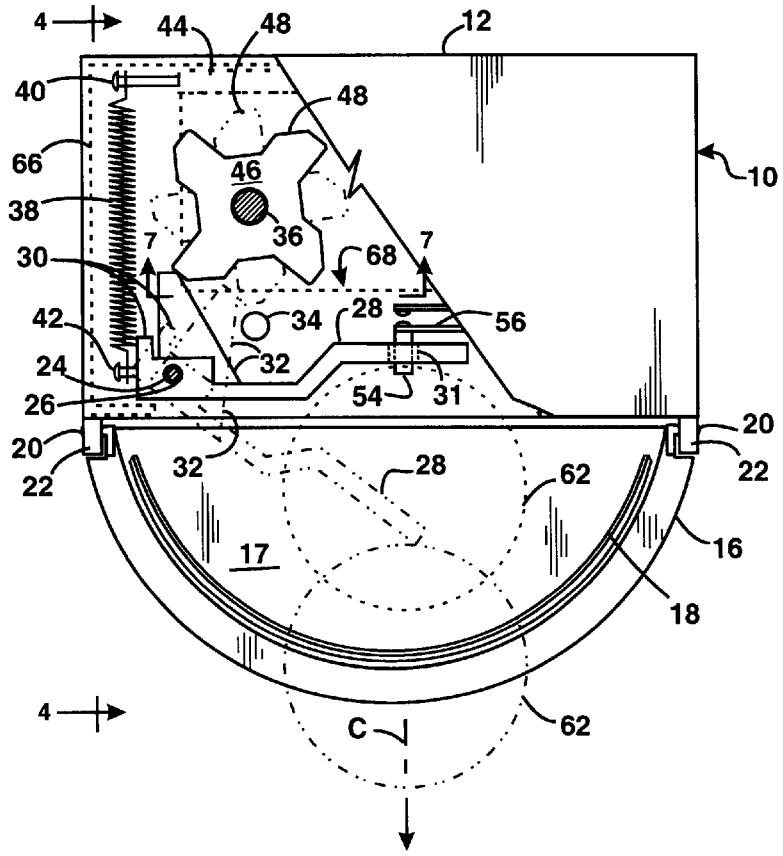
FIG. 3 is a longitudinal sectional view taken substantially along the line 3—3 in FIG. 2.
Figure 4:
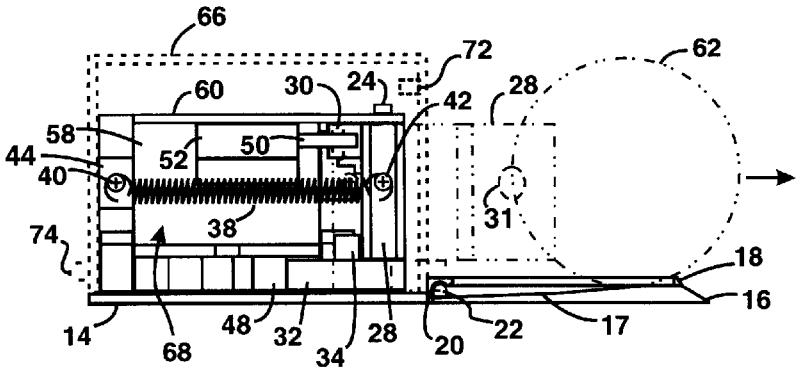
FIG. 4 is a fragmentary sectional view taken generally along line 4—4 of FIG. 3 in the direction of the arrows, with the outline of the shell of the device shown in dashed lines for simplicity.
Figure 6:
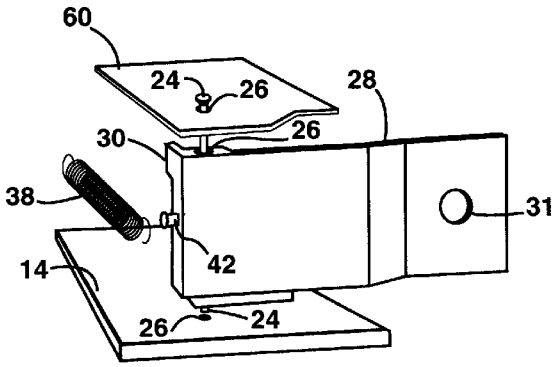
FIG. 6 is an exploded, perspective view of the ball return flipper device embodied in the golf putting practice device shown in FIG. 1, FIG. 2, FIG. 3, and FIG. 4.

Referring to FIG. 6 in particular, the flipper device 28 is pivotally secured at pivot hole 26 at the top support member 60 and the base 14 by the pivot rod 24 passing throughout which provides a vertical axis about which the flipper device 28 may pivot relative to the top support member 60 and base 14. Referring further to FIG. 3 and FIG. 4, the flipper device 28 is pivoted in a rearward direction by the cogwheel 46 against the resilient force created by the tension spring 38 at the connection between the pivotal anchor 42 of the flipper device and fixed anchor 40.

Figure 7:
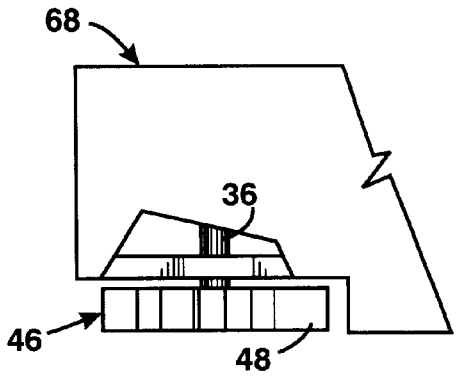
FIG. 7 is a partial side elevational view taken generally along line 7—7 of FIG. 3 in the direction of the arrows, with cutaway to show the attachment of the output axle of the motorized mechanism to the cogwheel.

Referring to FIG. 3, FIG. 4, and FIG. 7, the cogwheel 46 is attached to the motorized mechanism 68 which is mounted to the base 14 of the apparatus, and is provided to pivotally retract or cock and hold the flipper device 28 in the retracted position longitudinally along the rear face of the ball tray 16 as shown by solid lines in FIG. 3. The motorized mechanism 68 is engaged by an electric motor (not shown) that is provided with associated power means. As shown in FIG. 7, the cogwheel 46 is attached to the output axle 36 of the motorized mechanism 68 which extends perpendicularly through the central axis of the cogwheel 46. The cogwheel 46 is disposed adjacent to the trigger 32 of the flipper device 28 and engages the trigger 32 at the cogwheel arm 48 intersection point.

The cogwheel 46 is comprised of a plurality of protrusions originating from the central member that form cogwheel arms 48. As the cogwheel 46 rotates through the turning of the axle 36, the cogwheel arm 48 is brought into contact with the trigger 32 of the flipper device 28. The torque generated by the rotating cogwheel 46 against the trigger 32 pivots the flipper device 28 against the resistant force of the tension spring 38 into a rearward position along the back of the ball tray 16. This action elongates the tension spring 38 and exerts a resilient force at the pivotal end of the flipper device 28. The flipper device 28 is held at the maximum pivoted position as shown in FIG. 3 by the rotated cogwheel 46. When the cogwheel arm 48 advances further through rotation of the axle 36,, shown by broken lines in FIG. 3, the cogwheel arm 48 moves out of range of contact with the trigger 32 and thereby releases the flipper device 28 to pivot freely forward. The resilient action of the tension spring 38 returning to the normal configuration rapidly pivots the flipper device 28 in an arc movement about the pivotal axis formed by pivot rod 24 to a horizontally disposed position perpendicular to the ball tray 16 as shown by broken lines in FIG. 3 to eject the ball from the ball tray 16.

In the ball return means of the above arrangement, power means is associated with the electric motor that engages the motorized mechanism. The power means is interruptably connected by switch means to the electric motor. Referring to FIG. 3 and FIG. 4, when the output axle 36 rotates the cogwheel 46 and pivotally retracts the flipper device 28 to a predetermined position, the switch arm 30 on the flipper device 28 engages the resilient movable contactor 50 of the retractor switch 52 and thereby interrupts the power means to the motorized mechanism 68 and further causes the rearwardly pivoting of the flipper device 28 to terminate. When the ball 62 rolls into the back of the ball tray 16 and comes to rest against the release switch 54 located at the switch opening 31of the flipper device 28, as shown in FIG. 3, and depresses the resilient movable contactor 56, power is restored to the motorized mechanism 68 and the cogwheel 46 is rotated further by the turning of the output axle 36. This action rotates the cogwheel arm 48 out of contact with the trigger 32, thereby, releasing the flipper device 28. The contraction of the tension spring 38 from the elongated position forces the flipper device 28 to quickly and forcefully pivot forward to a horizontally disposed position perpendicular to the ball tray 16. This forward pivoting of the flipper device 28 disengages the switch arm 30 of the flipper device from the resilient movable contactor 50 of the retractor switch 52 and restores power to the motorized mechanism 68. As a result, the output axle 36 rotates the cogwheel 46 which engages the extended trigger 32 of the flipper device 28 as shown in FIG. 3 to again retract the flipper device 28 to the retracted position along the rear face of the ball tray 16 in order to repeat the ball return process.

Although the present invention describes the resilient movable contactor 56 and the release switch 54 as located at the switch opening 31 of the flipper device 28, switches of these types may be located at alternative positions in proximity to the flipper device 28 to provide proper ball returning operation and still remain within the scope of the herein described invention.

The present embodiment of the putting practice device 10 employs a pivotally mounted ball tray 16 that is secured to the base 14 at pivot socket 22 by pivot arm 20. The invention contemplates the provision of attachment means that will allow the ball tray 16 to detach from the apparatus at the pivot socket 22 in the event an extreme force that could cause structural damage is applied to the ball tray 16.

The distance along the longitudinal center line of the putting path, as identified by the letter C in FIG. 3, from the entrance of the ball tray 16 to the flipper device 28 represents approximately one-half of the diameter of a regulation golf hole, thereby requiring minimal sloping of the ball tray floor 17 to direct the ball 62 into the ball pocket 64. This affords the ball tray 16 a substantially lower profile at the front entrance of the tray for easier putting of the ball thereinto.

Referring to FIG. 3 and FIG. 4, the invention also contemplates the provision of a ball retarding rib 18 at the entrance to the ball tray 16 to check the speed of a ball travelling into the ball tray 16 and further to aid in retaining a ball 62 inside the parameter of the ball tray 16 once it has entered thereto, unless said ball is directed thereto at excessive speed.

Referring to FIG. 4, the device 10 of the present embodiment is further provided, as mounted in the main housing 12 part, with a light emitting diode (LED) 72 that is connected to the main switch 74 which turns on and shuts off power to the device 10. Activating power to the device 10 causes the light emitting diode (LED) 72 to illuminate and thereby indicates the device 10 is turned on.

Figure 2:
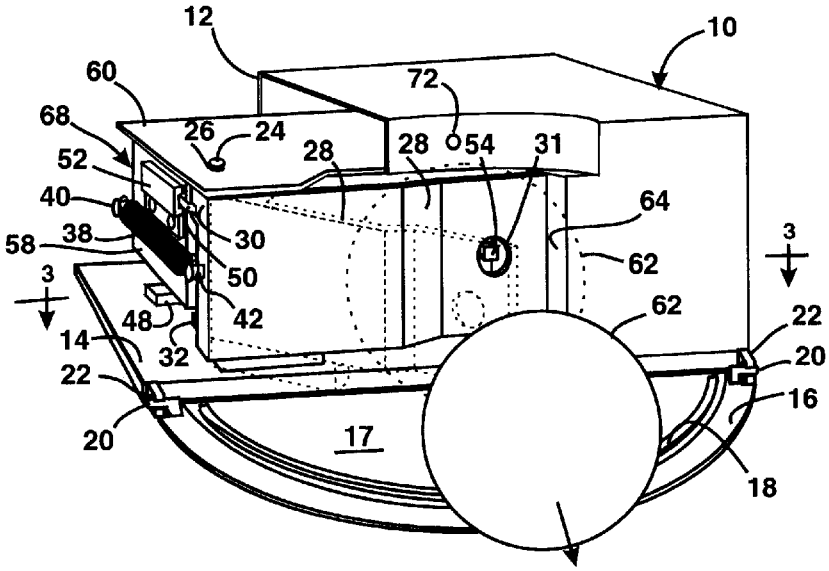
FIG. 2 is a front perspective view similar to FIG. 1 with a portion of the shell cut away to show in more detail the ball return flipper device.

The operation of the putting practice device according to the present invention shall be described next as summarized. Referring to FIG. 2 and FIG. 3, when the putted ball successfully enters the ball tray 16, the ball comes to rest in the ball pocket 64 and against the release switch 54 which is affixed to the resilient movable contactor 56, shown in FIG. 3, at the switch opening 31. The flipper device 28 is disposed longitudinally along the rear face of the ball tray 16 in the retracted position against the resilient force of the tension spring 38 by the cogwheel arm 48. The cogwheel 46 rotates about the output axle 36 and engages the trigger 32 of the flipper device 28 at the intersection with cogwheel arm 48.

Referring to FIG. 2 and FIG. 4, in the retreated position, the switch arm 30 of the flipper device 28 engages the resilient movable contactor 50 of the retractor switch 52 and thereby shuts off the power to the motorized mechanism 68. When the ball 62 rests against and depresses the release switch 54, as shown in FIG. 3, the resilient movable contactor 56 restores power to the motorized mechanism 68 which rotates the cogwheel 46 through the turning of the output axle 36. This action advances the cogwheel arm 48 out of range of contact with the trigger 32 and releases the flipper device 28 to rapidly pivot forward under the resilient contracting force of the tension spring 38, shown by broken lines in FIG. 3. The forward pivoting motion of the flipper device 28 is halted by the trigger stop 34, thereby ejecting the ball 62 from the ball tray 16 and returning the ball back to the person making the putt.

Referring again to FIG. 2 and FIG. 3, concurrently, with the flipper device 28 in the released ball return mode, the switch arm projection 30 disengages the resilient movable contactor 50 of the retractor switch 52 and restores power to the motorized mechanism 68. This action causes the output axle 36 to rotate the cogwheel 46 to a position where the cogwheel arm 48 engages the extended trigger 32 of the flipper device 28 and pivots the flipper device 28 against the resilient force of the tension spring 38 to a longitudinally retreated position along the rear face of the ball tray 16 where the ball return process can be repeated.

With the above arrangement of ball returning means, the intended ball return operation can be realized by the energy of a battery or batteries accommodated in the device which requires no connecting to any external commercial power source which further enhances the extreme portability of the device.

Figure 5:
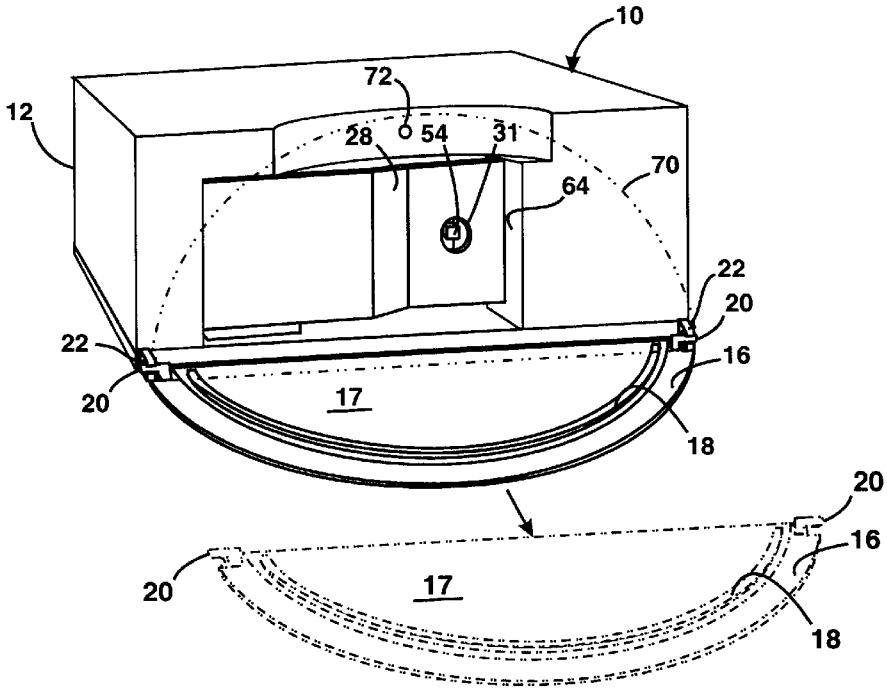
FIG. 5 is a front perspective view similar to FIG. 1 with the ball receiving tray in the raised position for storage shown in dashed lines.

Referring to FIG. 4 and FIG. 5, the ball tray 16 is substantially permanently attached pivotally at pivot socket 22 by pivot arm 20 to the base 14 of the putting practice device 10 and is characterized by a sufficiently shallow depth measured along the longitudinal center line of the putting path as identified by the letter C in FIG. 3 from the front entrance of the ball tray 16 to the ball pocket 64 of the flipper device 28, representing substantially one-half of the diameter of a regulation golf hole. Henceforth, this requires only a minimal slope in the ball tray floor 17 to direct the ball 62 into the ball pocket 64 formed by the intersection of the flipper device 28 and the face of the main housing 12. Thusly, the front entrance of the ball tray 16 allows the putted ball to enter without the necessity of a ramp.

Referring to FIG. 5, the ball tray 16 of the present invention is substantially affixed as a permanent component of the main housing and can be pivoted in an upward direction from the normally flat position for ball retrieval in the intended use to fold substantially against the main housing 12 for storage or transport of the device 10, as shown by the dashed lines. The current embodiment contemplates attachment means to allow dislodgment of the ball tray 16 from the main apparatus at the pivot points when an external force is exerted on ball tray 16 in a catastrophic manner, as when the device is dropped, to prevent structural damage at the pivotal connection.

Notwithstanding the forgoing, it is obvious that numerous changes may be made in the form, construction and arrangement of the several parts without departing from the spirit or scope of the invention, or sacrificing any of its attendant advantages, the form herein disclosed being a preferred embodiment for the purpose of illustrating the invention and not intended in a limiting sense.

Having thus described the invention, I hereby claim:

1. A golf putting apparatus comprising:

a base and housing member;

a spring-powered ball return flipper device;

a tension spring; a ball tray;

means for mounting said spring-powered ball return flipper device in said putting apparatus for pivotal movement between a substantially normal retracted position disposed at a rear face of the ball tray to a released extended position perpendicular to said ball tray to eject a ball from the tray;

a means for mechanically effecting pivotal movement of said flipper device from said extended position to said retracted position against the resilient force of the tension spring;

power means for pivoting said flipper device from said extended position to said retracted position;

a means to stop the forward pivoting movement of said flipper device in a manner to propel the ball from said ball tray; and a means for attaching a ball tray pivotally to said apparatus as a component thereof for receiving a golf ball putted thereinto.

2. The golf putting apparatus of claim 1, wherein said flipper device is a pivotally mounted elongated member connected at an anchor point of a pivotal end to said tension spring which is further connected at one end of said spring to a secondary fixed anchor.

3. The apparatus of claim 1, wherein said means for mounting said flipper device comprises a generally vertical axis extending through said flipper device between the base and housing member wherein said flipper device pivots between said retracted position and said released position in a manner to eject the ball from said ball tray.

4. The apparatus of claim 1, wherein said means of pivotal movement of said flipper device from said retracted position to said extended position is the resilient force created by the tension spring returning to it's normal contracted length in the connection of said tension spring between a pivoting end of said flipper device and a fixed second anchor connection.

5. The apparatus of claim 1, wherein said stop means is comprised of a structural element attached to said apparatus and located in the pivotal path of a trigger of said flipper device in such a manner to stop the forward pivoting of said flipper device at a determined point.

6. The apparatus of claim 2, wherein said elongated member is provided with a recessed end opposite the pivotal end where said elongated member meets an opposite end of said housing member wall to form a ball pocket when said elongated member is retracted along the rear face of said ball tray.

7. The apparatus of claim 6, wherein said elongated member contains a formed opening in said ball pocket area for the protrusion of a ball return release switch.

8. The apparatus of claim 1, further including means for pivoting of said flipper device that includes mechanical means wherein a cogwheel is attached to a motorized mechanism output axle in a manner to effect rotation of said cogwheel in relation to turning of said axle and thereby engage a trigger of said flipper device and pivot said flipper device against the resilient force of said tension spring.

9. The apparatus of claim 1, wherein said mechanical means includes an electric motor means associated with said mechanical means for rotating a cogwheel and power means associated with said electric motor.

10. The golf putting apparatus of claim 1, wherein said ball tray is attached to said apparatus by connector means to allow displacement of said ball tray pivotally about said putting apparatus.

11. The apparatus of claim 10, wherein said ball tray is attached to said base member and is connected by means that allow automatic disconnection of said ball tray from said base member to prevent structural damage at said connection in the event an external force is applied to said ball tray in a catastrophic manner.

* * * * *